US008109013B2

(12) United States Patent
Parrott

(10) Patent No.: US 8,109,013 B2
(45) Date of Patent: Feb. 7, 2012

(54) PROTECTIVE COVER DEVICE FOR A SKATE BOOT

(76) Inventor: Lawrence B. Parrott, Minnedosa (CA)

( * ) Notice: Subject to any disclaimer, the term of this patent is extended or adjusted under 35 U.S.C. 154(b) by 404 days.

(21) Appl. No.: 12/428,787

(22) Filed: Apr. 23, 2009

(65) Prior Publication Data

US 2009/0265960 A1 Oct. 29, 2009

Related U.S. Application Data

(60) Provisional application No. 61/047,204, filed on Apr. 23, 2008.

(51) Int. Cl.
*A43B 5/00* (2006.01)

(52) U.S. Cl. ..... 36/72 R; 36/115; 36/136

(58) Field of Classification Search ..... 36/72 R, 36/115, 132, 136
See application file for complete search history.

(56) References Cited

U.S. PATENT DOCUMENTS 2,829,449 A * 4/1958 Edwards et al. ..... 36/72 R
2,842,872 A * 7/1958 Shultz ..... 36/72 R
3,334,427 A * 8/1967 Edwards et al. ..... 36/72 R
3,806,145 A 4/1974 Czeiszperger
4,351,537 A * 9/1982 Seidel ..... 280/11.12
4,445,287 A 5/1984 Garcia
5,234,230 A 8/1993 Crane et al.
5,566,476 A 10/1996 Bertrand et al.
D379,395 S 5/1997 Aird
5,711,092 A * 1/1998 Despres et al. ..... 36/72 R
5,829,170 A 11/1998 Lutz, Jr.
6,854,200 B2 2/2005 Hipp et al.
7,021,663 B1 4/2006 Moran
7,523,567 B1 * 4/2009 McClelland ..... 36/115

* cited by examiner

*Primary Examiner* — Marie Patterson
(74) *Attorney, Agent, or Firm* — Ryan W. Dupuis; Kyle R. Satterthwaite; Ade & Company, Inc.

(57) ABSTRACT

A protective cover device for a skate boot comprises a panel member including a central portion spanning part of the skate tongue and two side portions extending outwardly and downwardly from the central portion to span towards respective inner and outer sides of the skate. Anchor members at the outer side anchor the panel member to the skate boot using apertures which receive portions of the skate laces therethrough. The anchor members at the outer side also form hinges onto which the panel member is pivotally coupled for selectively providing access to the laces for fastening. An anchor member at the inner side comprises a strap which is selectively fastened to a mating fastener on a bottom side of the skate boot.

19 Claims, 4 Drawing Sheets

PROTECTIVE COVER DEVICE FOR A SKATE BOOT

This application claims the benefit under 35 U.S.C. 119(e) of U.S. provisional application Ser. No. 61/047,204, filed Apr. 23, 2008.

FIELD OF THE INVENTION

The present invention relates to a protective device for covering a portion of a boot of an ice skate.

BACKGROUND

In various sports it is common to provide covers on footwear either for ornamental or protective reasons. In the sport of hockey it is particularly desirable to protect a foot of the wearer of a hockey skate from injury resulting from impacts of pucks being shot during game play. The portion of the skate boot which covers the top of the foot typically has poor padding or shielding to allow lacing of the skate securely against the foot of the wearer and to allow some flexibility to the movement of the foot of the wearer during use. Accordingly the limited padding provided at the top portion of the skate results in an area which is prone to injury.

The following prior patents relate generally to covers for various types of footwear.

U.S. Pat. No. 5,566,476 belonging to Bertrand et al. discloses a cover for being worn over a sports shoe which is not suited for mounting onto a hockey skate nor would it provide suitable protection to the top portion of the skate boot.

U.S. Pat. No. 5,234,230 belonging to Crane et al. discloses ankle and foot protective devices for attachment to a skate. The pads disclosed however are particularly cumbersome to attach and are quite bulky resulting in interference to the player's movements in a hockey game. In the course of a hockey game, skaters perform very intricate movements with their skates such as forward and backward cross cuts in which skates quickly brush by each other, and tight turns in which skates are parallel to each other but only slightly in front of the other such that an inside toe may touch the inside heel of the skate leading the turn. These movements are quick and tight as any hockey player could attest to. Adding what appears to be almost an inch of padding on each side of the skate would most certainly restrict if not make skating in a hockey game impossible.

U.S. Pat. No. 4,445,287 belonging to Garcia discloses a skate boot cover which functions as a thermal wrap designed for warmth and attachment to a figure skate. The device is not well suited for protective use in a hockey skate.

U.S. Pat. No. 3,806,145 belonging to Czeiszperger discloses a skate shoe guard for protecting a toe cup and an inner side of a skate for goalies in the game of hockey, however no protection is provided for the top area of the foot.

U.S. design Pat. No. 379,395 belonging to Aird discloses a bumper for a skate boot which provides no protection to the top area of the foot.

U.S. Pat. No. 7,021,663 discloses a protective cover for a hockey skate formed of suitably rigid protective material. The cover however is designed to extend over all parts of the skate boot which typically cover the foot, the ankle and the lower part of the shin bone. The skate thus requires hinging at the ankle area to provide for a natural skating motion. By providing protective material which fully spans the skate boot, this cover interferes with the hinging effect required in a skate boot as the hinging area typically required of a skate at a point approximately three eyelets down from the top of the skate is covered and prevented from functioning normally. Furthermore the cover appears cumbersome to attach to a skate to fully cover access to the laces of the skate.

U.S. Pat. No. 6,854,200 belonging to Hipp et al. and U.S. Pat. No. 5,829,170 to Lutz, Jr. disclose similar protective covers for hockey skates which cover over a top portion and both inner and outer sides of the skate boot as an integral protective member. Due to the wrap around configuration of the cover in each instance, the cover is not suited for adapting to various widths and sizes of skates but rather multiple different sizes must be manufactured for accommodating all wearers. Furthermore neither design attaches directly to the skate, but rather straps are provided for extending about various portions of the skate which are then anchored back onto the protective cover rather than onto a particular location on the skate. Accordingly any impacts during a hockey game as a result of pucks or contacts with other players or sticks for example may cause the protective cover to readily come loose and be rotated about the skate even if the straps for fastening are not released.

The cover to Hipp et al in particular requires awkward alignment of a lower portion of the cover to an under side of the boot so that that design does not lend itself to easy and quick attachment as desired. As hockey players may need to retie or remove a skate several times during a hockey game, the awkward attachment of the prior art protective skate covers would require too much time and be too cumbersome for repeated attachment and removal.

In the protective cover to Lutz, the multiple straps require awkward mounting onto the skate with multiple hands to both hold the cover in place while also strapping about the skate so as to be particularly cumbersome for attachment and subsequent removal from the skate.

SUMMARY OF THE INVENTION

According to one aspect of the invention there is provided a protective cover device for partially covering a skate boot comprising a toe portion, a heel portion, an inner side extending between the toe portion and the heel portion, an outer side extending between the toe portion and the heel portion, a tongue portion extending from the toe portion towards the heel portion between the inner and outer sides, and laces arranged for fastening between the inner side and the outer side of the skate boot, the cover comprising:

a panel member comprising:

a central portion arranged to span at least a portion of the tongue portion of the skate boot; and two side portions extending outwardly and downwardly from opposing sides of the central portion so as to be arranged to span towards the inner and outer sides of the skate boot respectively;

the central portion and the two side portions being formed integrally with one another; and a plurality of anchor members arranged to anchor the panel member to the skate boot;

at least one of the anchor members comprising apertures arranged to receive a portion of the laces therethrough such that the panel member is arranged to be anchored relative to the laces.

By providing a protective cover device for a skate boot in which at least a portion of the cover can be anchored relative to laces of the skate, the cover is prevented from being flipped or twisted about the skate boot out of its desirable protective position on the top of the skate when impacted by pucks, sticks or other players as they occur several times during a hockey game.

The panel member may be arranged to span from the toe portion only partway towards an ankle portion of the skate boot.

The anchor members may be arranged to anchor the panel member to the laces at longitudinally spaced positions between the toe portion and the heel portion of the skate boot.

The apertures of said at least one of the anchor members are preferably spaced apart by a spacing corresponding to a spacing between adjacent eyelets in one of the sides of the skate boot which are arranged to receive the laces therethrough.

Preferably said at least one of the anchor members is arranged to be covered by the panel member in a mounted position of the panel member on the skate boot.

One of the side portions which is arranged to span towards the inner side of the skate boot is preferably longer in a lateral direction from the central portion than the other side portion which is arranged to span towards the outer side of the skate boot.

Preferably at least one of the anchor members comprises a hinge arranged to couple one of the side portions to a respective one of the inner and outer sides of the skate boot such that the panel member is pivotal relative to said one of the inner and outer sides of the skate boot between an open position in which the laces are arranged to be accessible and a closed position in which at least a portion of the tongue portion and the laces are covered by the panel member.

The hinge may be arranged to couple said one of the side portions to the outer side of the skate boot.

Preferably at least one of the anchor members comprises a readily releasable connector arranged to selectively secure the other side portion to the skate boot. The readily releasable connector may be coupled to the panel member by a flexible strap so as to be arranged for mating connection with a mating connector mounted beneath the skate boot.

Preferably two of the anchor members comprise hinges mounted at spaced positions along a respective one of the side portions of the panel member in which each of the hinges is arranged to receive the laces through respective apertures formed therein.

The hinges may include a hook portion arranged to extend over a top edge of the respective one of the inner and outer sides of the skate boot so as to be arranged for engagement with an inner surface of the side of the skate boot.

The hinge preferably includes apertures formed therein and arranged to receive the laces of the skate boot therethrough in which the apertures are arranged to be aligned with eyelets in the skate boot arranged to receive the laces therethrough when the hook portion is engaged against the top edge of the side of the skate boot.

According to a second aspect of the present invention there is provided a protective cover device for partially covering a skate boot comprising a toe portion, a heel portion, an inner side extending between the toe portion and the heel portion, an outer side extending between the toe portion and the heel portion, a tongue portion extending from the toe portion towards the heel portion between the inner and outer sides, and laces arranged for fastening between the inner side and the outer side of the skate boot, the cover comprising:

a panel member comprising:

a central portion arranged to span over at least a portion of the tongue portion and laces of the skate boot; and two side portions extending outwardly and downwardly from opposing sides of the central portion so as to be arranged to span towards the inner and outer sides of the skate boot respectively;

the central portion and the two side portions being formed integrally with one another; and a plurality of anchor members arranged to anchor the panel member to the skate boot;

at least one of the anchor members comprising a hinge arranged to couple one of the side portions to a respective one of the inner and outer sides of the skate boot such that the panel member is pivotal relative to said one of the inner and outer sides of the skate boot between an open position in which the laces are arranged to be accessible and a closed position in which at least a portion of the tongue portion and the laces are covered by the panel member.

By providing a hinge to anchor one side of the panel member, only a single fastener is required to be attached and released at the opposing side of the panel member to provide quick access to the laces for tying and untying the skate. Accordingly a protective cover device is described herein for a skate in which quick access to the laces is maintained after initial attachment of the protective device to the skate with the panel member being suitably anchored to remain in place protecting the most injury prone part of the foot of a wearer of a hockey skate, that is the top and top inside of the foot. Protecting this area allows a hockey player to block shots directly in front of the player which could occur several times in a game so that without the protective cover device of the present invention the foot is susceptible to injury.

Preferably the anchor members are arranged to anchor the panel member to the laces at longitudinally spaced positions between the toe portion and the heel portion of the skate boot.

Preferably the anchor members are arranged to be covered by the panel member in a mounted position of the panel member on the skate boot.

The hinge may include a first flange forming outer portion onto which the panel member is arranged to be pivotally coupled and a second flange connected to the first flange by a joining portion to define a hook portion arranged to extend over a top edge of the respective one of the inner and outer sides of the skate boot so as to be arranged for engagement with an inner surface of the side of the skate boot.

Preferably both the first flange and the second flange include apertures formed therein and arranged to receive the laces of the skate boot therethrough, the apertures of the first and second flanges being in alignment with one another and being arranged to be aligned with eyelets in the skate boot receiving the laces therethrough when the joining portion is engaged against the top edge of the side of the skate boot.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
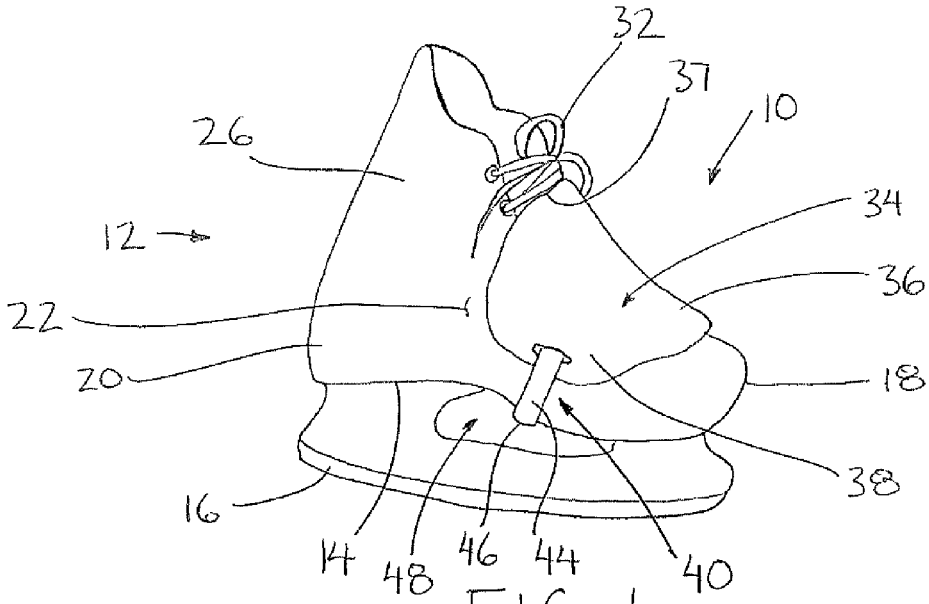
FIG. 1 is a perspective view of the protective cover device shown supported on a hockey skate according to a first embodiment of the present invention.

Referring to the accompanying figures there is illustrated a protective cover device generally indicated by reference numeral 10. The device 10 is particularly suited for partially covering the boot portion of a skate, for example the type commonly used in the sport of hockey. Although various embodiments are illustrated herein, the common features of the various embodiments will first be described.

A typical skate boot of a hockey skate 12 comprises a sole 14 at the bottom of the boot upon which the skate blades 16 are supported. The sole extends in a longitudinal direction between a toe portion 18 forming a cup which receives a toe of the foot of the person therein and a heel portion 20 which is wrapped about a heel of the foot of the person wearing the skate. The boot also includes an inner side 22 and an outer side 24 spanning along respective inner and outer sides of the foot of the wearer in the longitudinal direction between the toe portion and the heel portion of the skate boot. Each of the inner and outer sides comprises a lower foot portion spanning fully between the toe and heel portions of the boot and an upper ankle portion 26 extending upwardly from the lower foot portion above the ankle of the wearer adjacent the heel portion. The upper ankle portion 26 partially surrounds the lower leg of the person wearing the skate. The boot further comprises a tongue portion 28 which extends upwardly and rearwardly from the toe portion towards the heel portion at a location spanning between the inner and outer sides to cover the top of the foot of the wearer. A plurality of eyelets 30 are provided at spaced positions along each of the top edges of the inner and outer sides 22 and 24 respectively between which suitable laces 32 are fastened to fasten the upper top edges of the inner and outer sides together across the tongue portion 28 therebetween.

The protective cover device 10 includes a panel member 34 which covers the top portion of the skate boot at the location of the tongue portion 28 and the laces 32. In the illustrated embodiment, the panel member 34 comprises a single integrally molded piece of substantially rigid and impact resistant polyethylene which wraps around part of the skate boot to cover the laces and a portion of the inner side of the skate boot.

The panel member 34 includes a central portion 36 extending longitudinally from the toe portion over top of the tongue portion and the laces partway towards the ankle portion. The top edge 37 of the central portion is arranged to terminate only partway up the ankle portions of the inner and outer sides so as to extend only partway along the length of the tongue from the toe portion so as not to interfere with hinging movement at the ankle of a wearer of the skate boot.

The panel member 34 also comprises two side portions 38 which extend generally downwardly and outwardly from opposing longitudinally extending sides of the central portion 36 so that the side portions 38 extend towards the inner side and outer side 22 and 24 of the skate boot respectively. The two side portions 38 are curved downward and outwardly in a lateral direction away from the central portion so as to define a concave inner surface and a convex outer surface in the lateral direction which are substantially rigid in shape.

The inner side portion 38 arranged to span towards the inner side 22 is longer than the other outer side portion 38 so as to extend downwardly and at least partially cover the inner side 22 of the skate boot. The outer side portion 38 extending towards the outer side 24 overlaps the outer side 24 at the location of the eyelets to fully cover the laces received through the eyelets while a majority of the outer side 24 of the skate boot remains uncovered to accommodate various widths of skates.

A plurality of anchor members 40 are provided for anchoring the panel member 34 to the skate boot in a mounted position. Two anchor members 40 in the form of hinges 42 are provided at spaced positions along the side portion 38 of the panel arranged to be located at the outer side of the skate boot while a third anchor member 40, comprising a strap 44 and quick release connector 46, is provided on the opposing side portion 38 for mounting at the inner side 22 of the skate boot.

The connector 46 is arranged for selective mating connection with a suitable mating connector 48 fixed to the bottom side of the skate boot beneath the sole 14 of the boot between the heel and toe portions. The connector 46 is arranged for being readily released or connected and disconnected from the mating connector 48 for selectively securing the side portion 38 at the inner side of the boot. The strap 44 comprises an elastic tether which is flexible for spanning under tension between an aperture in the side portion 38 at the inner side of the skate boot and the mating connector 48 connected at the opposing end of the straps.

The hinges 42 are arranged to be supported at spaced apart positions in the longitudinal direction of the skate boot extending between the heel and toe portions of the skate boot so that the two hinges each anchor to respective portions of the laces of the skate boot corresponding to different eyelets spaced along the outer side 24 of the skate boot. The hinges cooperate together so that when the connector 46 is released, the panel member is hinged on the hinges 42 for pivotal movement between an open position in which access to the laces is fully unobstructed by the panel member which extends laterally outwardly to one side of the skate boot and a closed position in which the panel member fully covers the laces and the eyelets receiving the laces therein in the skate boot from the toe portion partway towards the ankle portion of the skate boot.

Each hinge is arranged to be secured to a respective plurality of the eyelets corresponding to different portions of the laces 32 longitudinally spaced along the tongue of the skate boot. Each hinge includes a base member 50 arranged to be fixed onto the skate relative to which the panel member is pivoted by suitable link members 52 coupled between the respective side portion 38 of the panel member and the base members 50 of the hinges.

Each base member comprises a first flange 54 forming an outer portion onto which the panel member is arranged to be pivotally coupled and a second flange 58 connected to the first flange by a joining portion 60 in a U-shaped configuration to define a hook portion arranged to extend over a top edge of the outer side of the skate boot. The second flange 58 is thus arranged for engagement with an inner surface of the outer side of the skate boot.

The first flange 54 includes two eyelets or apertures 56 formed therein and the second flange includes two eyelets or apertures 61 formed therein in which all of the apertures are arranged to receive the laces of the skate boot therethrough. The apertures of the first and second flanges are in alignment with one another.

Within each flange, the apertures 56 and 61 are spaced apart by a space corresponding to the space between two eyelets on a common side of the skate boot so that the apertures may be aligned with respective eyelets on the skate boot to receive the respective portions of the laces therethrough. The apertures are aligned with the eyelets in the skate boot when the joining portion 60 is engaged against the top edge of the inner side of the skate boot so that the second flange is hooked onto the side of the skate boot and retained thereon by laces extending through the aligned apertures and eyelets.

The first and second flanges are substantially parallel and spaced apart from one another so as to form the generally U-shaped configuration with the joining portion 60 extending therebetween along one edge. The second flange is arranged to be shorter than the first flange relative to the joining portion 60. The two eyelets or apertures 56 and 61 within each flange are located at equal distances from the joining portion 60 at a distance from the joining portion such that the apertures 61 in the second flange are located near the outer free edge 62 of the second flange 58.

The free edge 62 of the second flange 58 forming the edge farthest from the joining portion 60 is arranged to be curved or bent inwardly towards the first flange 54 such that the free edge 62 is arranged to better grip against an inner surface of the outer side 24 of the skate boot. The U-shaped configuration of the first and second flanges forms a hook portion of the hinge which is arranged to be hooked overtop of the top edge 63 of the outer side 24 of the skate boot along which the eyelets are located. The two apertures 56 located in the first flange 54 are positioned relative to the joining portions 60 such that when the joining portion forming the hook of the base member is engaged against the top edge 63 of the outer side of the skate boot, the two apertures 56 are aligned with respective ones of the eyelets in the outer side 24 of the skate boot.

The first flange 54 also includes a hinge aperture 64 therein which is generally centered in the longitudinal direction of the skate boot between the two lace apertures 56 while being spaced farther out from the joining portion 60 which engages the top edge 63 of the outer side of the skate boot than the lace apertures 56. In a mounted position the hinge aperture 64 is positioned further downward and laterally outward than the lace apertures 56 aligned with the eyelets in the skate boot as well as being further downward and laterally outward than the free edge 62 of the second flange.

Cooperating hinge apertures 66 are provided at spaced apart locations along the outer edge of the respective side portion 38 of the panel member for alignment with the hinge apertures 64 of the two hinges so that that link members 52 may couple the panel member to the two base members of the hinges by being coupled or received through the cooperating pairs of hinge apertures 64 and 66.

The space between the two hinge apertures 66 in the side portion 38 at the outer side of the panel member are spaced apart in the longitudinal direction by a space corresponding to the space between a prescribed number of boot eyelets along the outer side 24 of the skate boot so that when the two hinges members are aligned with respective eyelets on the outer side of the skate boot, the hinge apertures in the base members of the hinges will align with the hinge apertures spaced apart in the panel member 34.

By locating the hinge apertures 64 in the base members of the hinges to be nearest the outer free edge of the base members farthest from the hook portion engaged with the top edge of the outer side of the skate boot, the panel member is hinged by the link members at the location which is farthest outward relative to the laces so that when hinged into the closed position the panel member fully spans over the hinges to fully cover the eyelets, the laces received therein and the tongue across which the laces extend in the closed position.

Each link member 52 comprises a generally flat band of elastic material formed into an annular link extending through the hinge apertures respectively for linking the panel member to the base members of the hinges.

Figure 2:
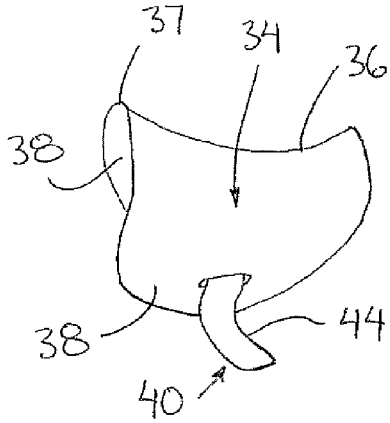
FIG. 2 is a perspective view of the protective device of FIG. 1 shown separated from a skate.
Figure 3:
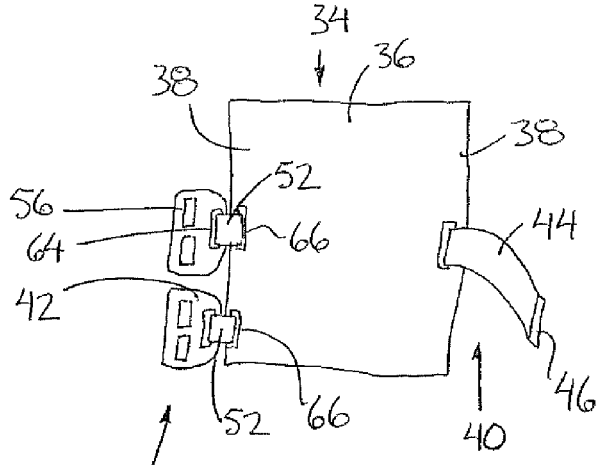
FIG. 3 is an underside view of the protective cover device of FIG. 1 shown removed from a skate.
Figure 4:
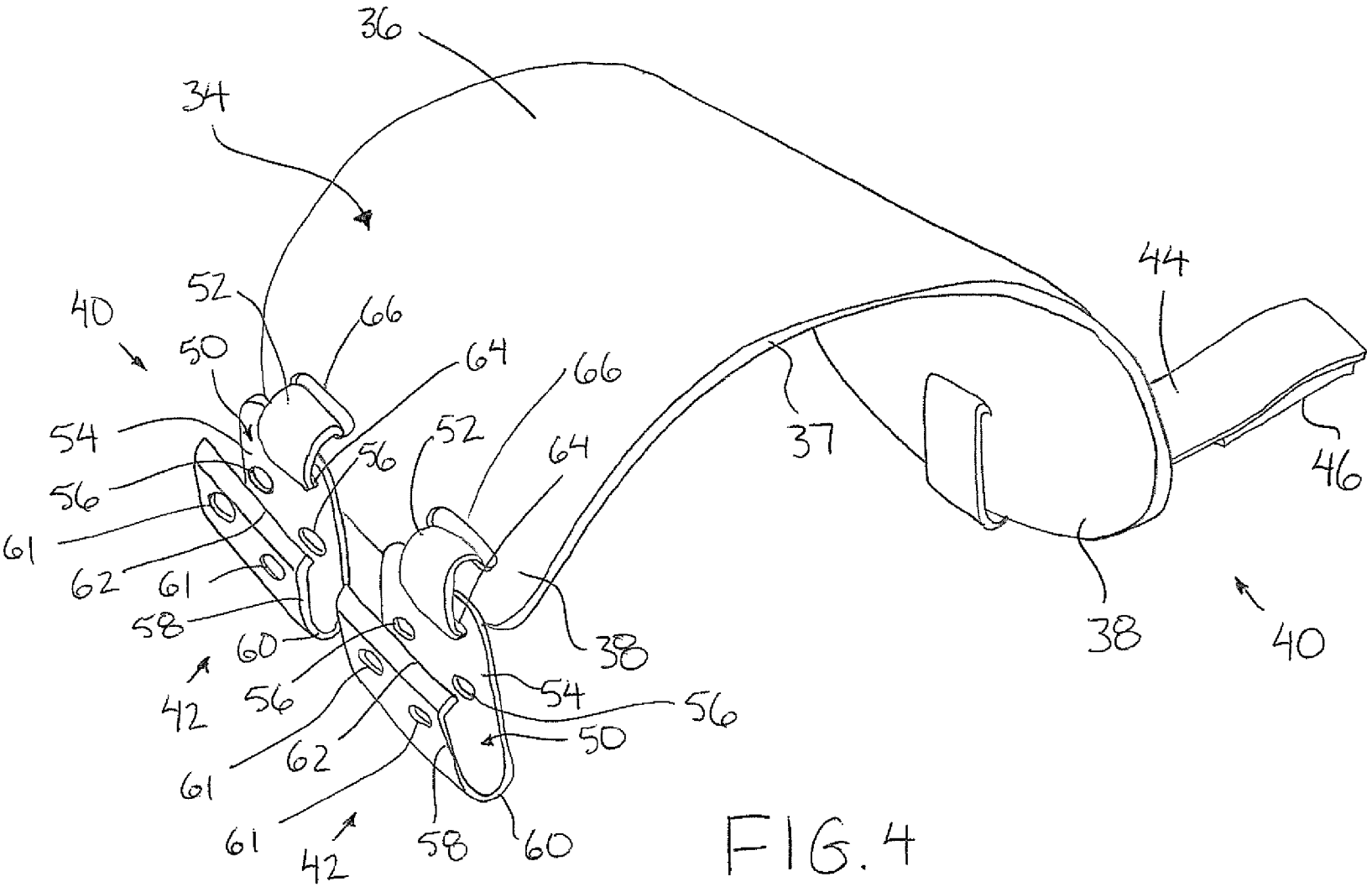
FIG. 4 is a perspective view of a second embodiment of the protective cover device.
Figure 5:
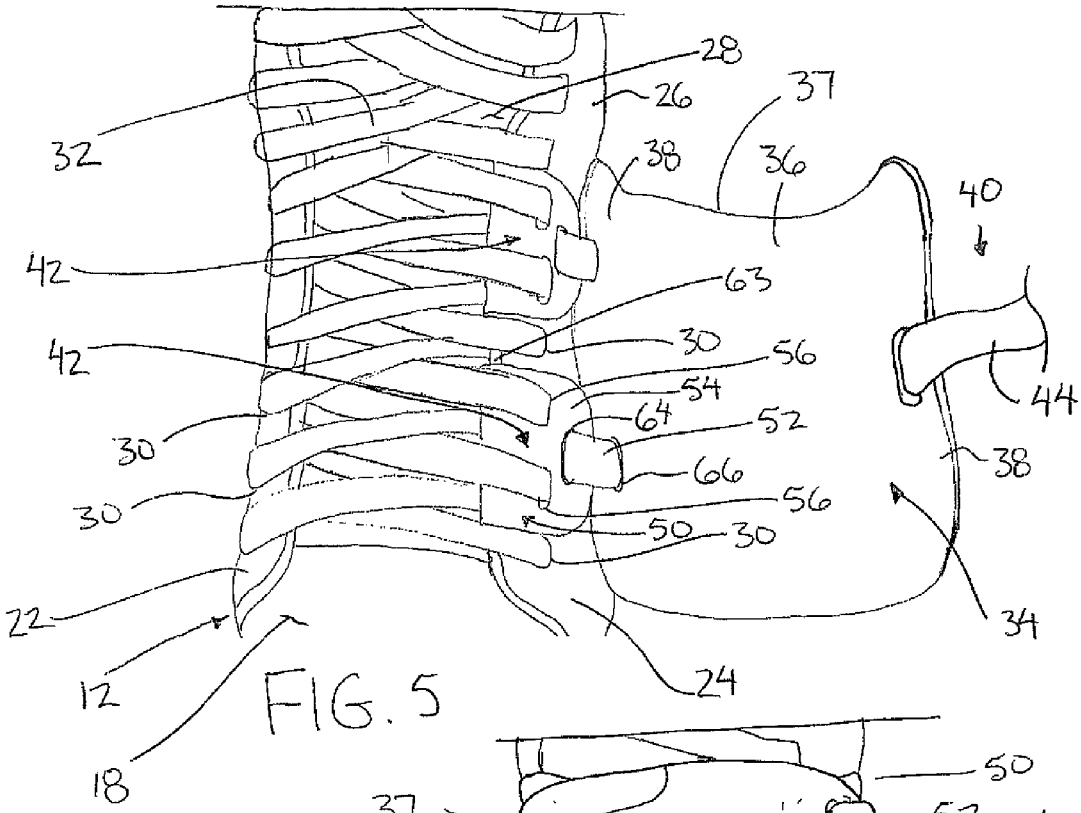
FIG. 5 is a front elevational view of the protective cover device of FIG. 4 shown supported on a skate in the open position.
Figure 6:
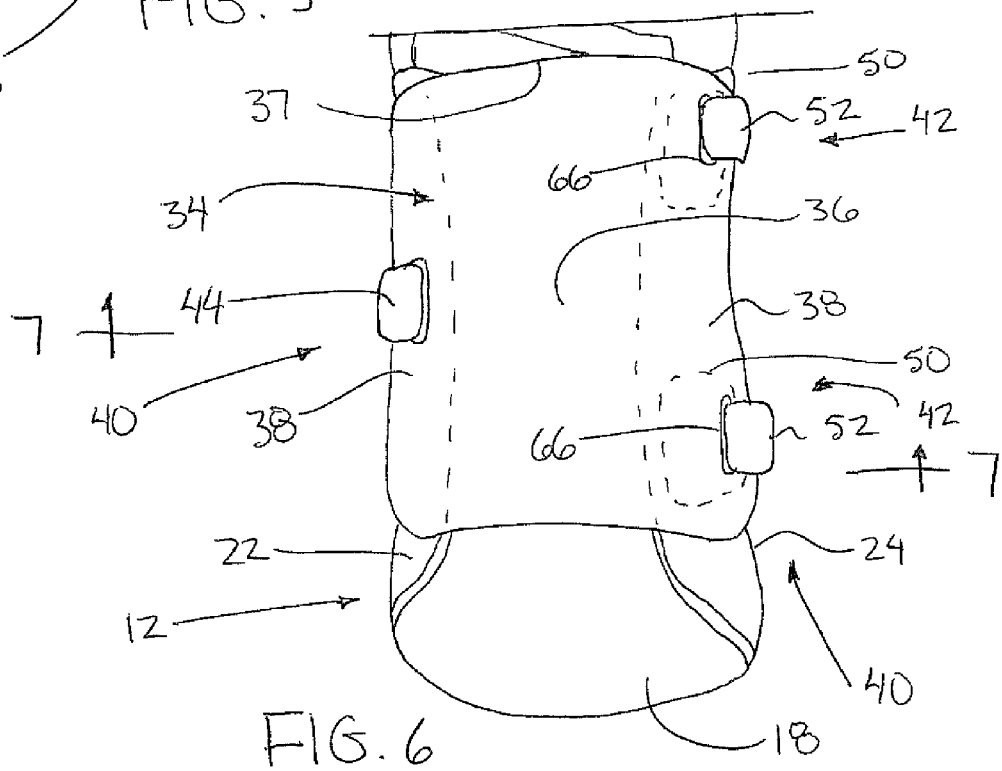
FIG. 6 is a front elevational view of the protective cover device of FIG. 4 shown supported on a skate in a closed position.
Figure 8:
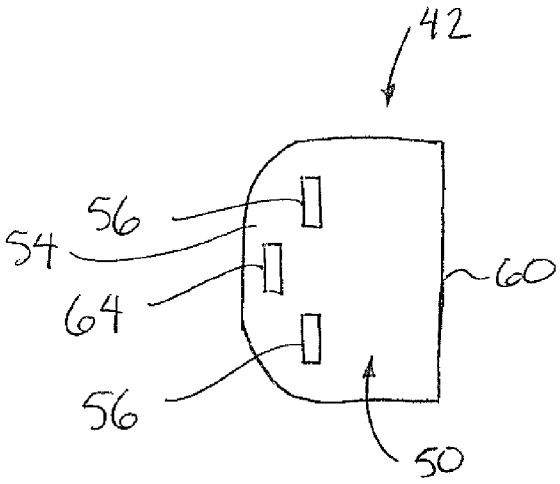
FIG. 8 is a top plan view of a base member of one of the hinges according to either one of the first and second embodiments.
Figure 9:
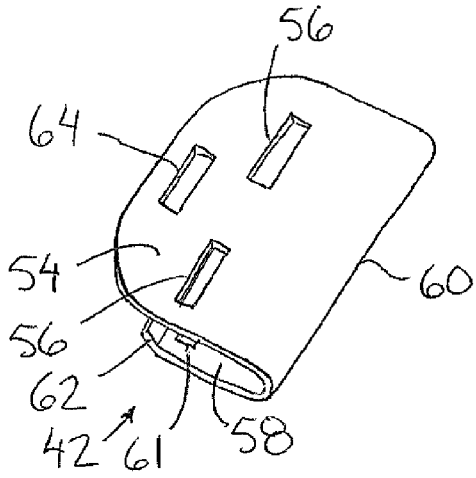
FIG. 9 is a perspective view of the base member of FIG. 8.
Figure 7:
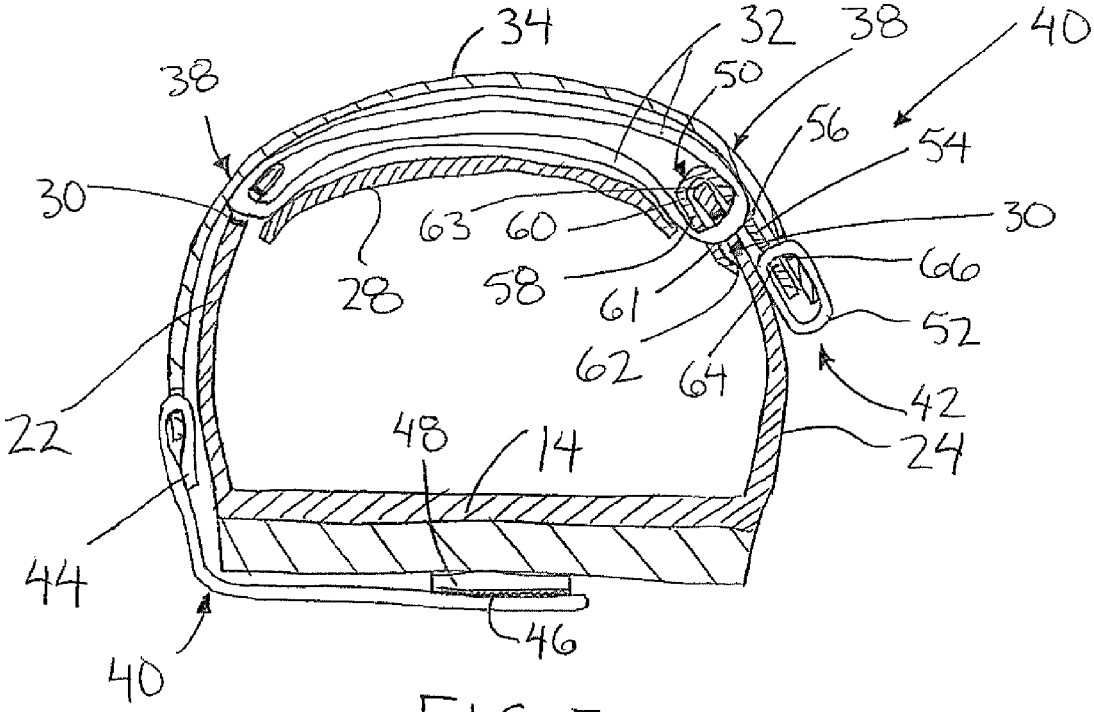
FIG. 7 is a sectional view along the line 7-7 of FIG. 6.

Turning now more particularly to the first embodiment shown in FIGS. 1 through 3, the central portion 36 is curved in both the lateral direction which the side portions 38 span from the central portion as noted above, as well as being perpendicular in a longitudinal direction of the tongue of the skate boot which is perpendicular to the later direction. The central portion which extends in the longitudinal direction between opposing ends of the panel member in this instance is curved so as to have a concave outer surface and a convex inner surface in the longitudinal direction. The central portion thus comprises a compound curve in which the outer surface is concave in the longitudinal direction and a convex in the lateral direction. The central portion 36 is thus suitably curved to follow the contour of the skate extending upwardly in front of the upper ankle portion 26 and downwardly along the two sides of the boot.

In the second embodiment, the central portion 36 is substantially straight in the longitudinal direction of the tongue of the skate boot between opposing ends of the panel member while remaining curved in the lateral direction which the side portions 38 span from the central portion. In this manner, the construction of the panel member 34 is simplified while the panel member remains adequate in shape for conforming to the shape of the skate boot to cover the lower portion of the tongue of the skate boot together with an upper portion of the inner and outer sides of the skate boot.

In use, a user initially secures the protective device 10 to a skate by removing the laces and placing the two base members 50 of the two hinges respectively so that the hook portions thereof are engaged overtop of the top edge of the outer side of the skate boot while the lace apertures 56 and 61 therein are aligned with respective eyelets so that the skate can be laced in the normal manner through the eyelets and the corresponding laces apertures 56 and 61 in the hinges.

In the open position of the panel member, fully unobstructed access is provided to the laces so that a user can lace up their skates in a normal manner while the panel member remains attached to the skate boot even after the laces are loosened and the skate is removed from the foot of the wearer. The mating connector 48 is fixedly secured by suitable adhesive or other mechanical fastening means to the bottom side of the skate boot so that once installed thereon, the connector 46 at the end of the strap 44 forming one of the anchor members 40 at the inner side of the panel member can be readily connected and disconnected from the mating connector 48 as may be desired for attaching or releasing the panel member from the closed position.

As described herein the protective cover device comprises a piece of hockey equipment which forms a protective armour over a top portion of a skate. The body of the panel member is made of impact resistant plastic, for example polycarbonate or more preferably polyethylene, which wraps around the skate laces and also covers part of the inside of the skate. The panel is attached to the skates using two clips or hinges which extend over the outer side of the skate eyelets when the skate is unlaced. Once the clips are in place the skate is laced up in the usual manner so that the panel member is secured by the two hinges at two spaced apart locations at the outer side of the skate. A third and final point of attachment is provided on the inside of the skate by the elastic strap which attaches from the inner side of the panel member to a bottom side of the skate. A suitable form of mating connector may include hook and loop fasteners, for example Velcro. The hinging of the panel member to the laces of the skate serves both to provide ready access for ease of lacing and unlacing the skate boot from the foot of a wearer while also suitably anchoring the panel member against relative movement in relation to the skate boot when impacted during a game of hockey so that the panel member does not become misaligned with the top area of the skate or foot to be protected.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A protective cover device in combination with a skate boot for partially covering the skate boot in which the skate boot comprises a toe portion, a heel portion, an inner side extending between the toe portion and the heel portion, an outer side extending between the toe portion and the heel portion, a tongue portion extending from the toe portion towards the heel portion between the inner and outer sides, and laces fastened between eyelet locations spaced along the inner side and the outer side of the skate boot, the cover device comprising:

a panel member comprising:

a central portion arranged to span at least a portion of the tongue portion of the skate boot; and two side portions extending outwardly and downwardly from opposing sides of the central portion so as to be arranged to span towards the inner and outer sides of the skate boot respectively;

the central portion and the two side portions being formed integrally with one another; and a plurality of anchor members arranged to anchor the panel member to the skate boot;

the anchor members including a hinge structure including apertures arranged to receive different portions of the laces therethrough corresponding to different eyelet locations spaced along one of the inner and outer sides of the skate boot such that:

the hinge structure is anchored relative to the different portions of the laces spaced along said one of the inner and outer side of the skate boot; and the panel member is pivotal relative to the hinge structure between an open position in which the laces are readily accessible and a closed position in which at least a portion of the tongue portion and the laces are covered by the panel member.

2. The device according to claim 1 wherein the panel member is arranged to span from the toe portion only partway towards an ankle portion of the skate boot.

3. The device according to claim 1 wherein the hinge structure is arranged to anchor the panel member to the laces at longitudinally spaced positions between the toe portion and the heel portion of the skate boot.

4. The device according to claim 1 wherein the apertures of the hinge structure are spaced apart by a spacing corresponding to a spacing between corresponding eyelets in one of the sides of the skate boot which are arranged to receive the laces therethrough.

5. The device according to claim 1 wherein the hinge structure is arranged to be covered by the panel member in a mounted position of the panel member on the skate boot.

6. The device according to claim 1 wherein one of the side portions which is arranged to span towards the inner side of the skate boot is longer in a lateral direction from the central portion than the other side portion which is arranged to span towards the outer side of the skate boot.

7. The device according to claim 1 wherein the hinge structure is arranged to couple the respective side portion to the outer side of the skate boot.

8. The device according to claim 1 wherein at least one of the anchor members comprises a readily releasable connector arranged to selectively secure the other side portion to the skate boot opposite the hinge structure.

9. The device according to claim 8 wherein the readily releasable connector is coupled to the panel member by a flexible strap so as to be arranged for mating connection with a mating connector mounted beneath the skate boot.

10. The device according to claim 1 wherein the hinge structure comprises two hinges mounted at spaced positions along a respective one of the side portions of the panel member, each of the hinges being arranged to receive the respective portions of the laces through the respective apertures formed therein.

11. The device according to claim 1 wherein the hinge structure comprises at least one hinge including a hook portion arranged to extend over a top edge of the respective one of the inner and outer sides of the skate boot so as to be arranged for engagement with an inner surface of the side of the skate boot.

12. The device according to claim 11 wherein said at least one hinge includes apertures formed therein and arranged to receive the laces of the skate boot therethrough, the apertures being arranged to be aligned with eyelets in the skate boot arranged to receive the laces therethrough when the hook portion is engaged against the top edge of the side of the skate boot.

13. A protective cover device in combination with a skate boot for partially covering the skate boot in which the skate boot comprises a toe portion, a heel portion, an inner side extending between the toe portion and the heel portion, an outer side extending between the toe portion and the heel portion, a tongue portion extending from the toe portion towards the heel portion between the inner and outer sides, and laces fastened between eyelet locations spaced along the inner side and the outer side of the skate boot, the cover device comprising:

a panel member comprising:

a central portion arranged to span over at least a portion of the tongue portion and laces of the skate boot; and two side portions extending outwardly and downwardly from opposing sides of the central portion so as to be arranged to span towards the inner and outer sides of the skate boot respectively;

the central portion and the two side portions being formed integrally with one another; and a plurality of anchor members arranged to anchor the panel member to the skate boot;

two of the anchor members comprising hinges coupling the panel member to a respective one of the inner and outer sides of the skate boot at spaced positions along one of the side portions of the panel member such that the panel member is pivotal relative to said one of the inner and outer sides of the skate boot between an open position in which the laces are arranged to be accessible and a closed position in which at least a portion of the tongue portion and the laces are covered by the panel member; and the hinges including respective apertures receiving respective portions of the laces therethrough.

14. The device according to claim 13 wherein the hinges are arranged to anchor the panel member to the laces at longitudinally spaced positions between the toe portion and the heel portion of the skate boot.

15. The device according to claim 13 wherein the hinges are covered by the panel member in the closed position of the panel member on the skate boot.

16. The device according to claim 13 wherein the hinges couple the respective side portion to the outer side of the skate boot.

17. The device according to claim 13 wherein at least one of the anchor members comprises a readily releasable connector arranged to selectively secure the other side portion to the skate boot, the readily releasable connector being coupled to the panel member by a flexible strap so as to be arranged for mating connection with a mating connector mounted beneath the skate boot.

18. The device according to claim 13 wherein each hinge includes a first flange forming outer portion onto which the panel member is arranged to be pivotally coupled and a second flange connected to the first flange by a joining portion to define a hook portion arranged to extend over a top edge of the respective one of the inner and outer sides of the skate boot so as to be arranged for engagement with an inner surface of the side of the skate boot.

19. The device according to claim 18 wherein both the first flange and the second flange include apertures formed therein and arranged to receive the laces of the skate boot therethrough, the apertures of the first and second flanges being in alignment with one another and being arranged to be aligned with eyelets in the skate boot receiving the laces therethrough when the joining portion is engaged against the top edge of the side of the skate boot.

* * * * *